US007428856B2

(12) United States Patent
Podkopayev

(10) Patent No.: US 7,428,856 B2
(45) Date of Patent: Sep. 30, 2008

(54) CONTROL PEDAL AND ASSIST MECHANISM

(75) Inventor: Vadym Podkopayev, Toronto (CA)

(73) Assignee: Intier Automotive Closures Inc., Newmarket, Ontario (CA)

( * ) Notice: Subject to any disclaimer, the term of this patent is extended or adjusted under 35 U.S.C. 154(b) by 403 days.

(21) Appl. No.: 11/047,798

(22) Filed: Jan. 31, 2005

(65) Prior Publication Data

US 2005/0167235 A1 Aug. 4, 2005

(51) Int. Cl.
*G05G 1/30* (2008.04)

(52) U.S. Cl. ..... 74/560; 74/512

(58) Field of Classification Search ..... 74/478, 74/512, 513, 560; 192/99 S
See application file for complete search history.

(56) References Cited

U.S. PATENT DOCUMENTS 1,810,103 A 6/1931 Flagstad
3,468,187 A * 9/1969 Payerle ..... 74/512
3,503,601 A * 3/1970 Wells ..... 267/169
4,319,497 A 3/1982 Shinto et al.
4,393,907 A * 7/1983 Kronstadt ..... 192/99 S
4,522,082 A 6/1985 Musumiya et al.
4,800,774 A * 1/1989 Hagiwara et al. ..... 74/512
4,846,012 A 7/1989 Papenhagen et al.
4,973,030 A * 11/1990 Leonard ..... 267/71
5,215,176 A * 6/1993 Hamann ..... 192/99 S
5,555,774 A 9/1996 Lauring et al.
6,454,075 B1 * 9/2002 Leuschke et al. ..... 192/99 S
6,592,494 B2 7/2003 St. Pierre et al.
2001/0011487 A1 * 8/2001 Kojima et al. ..... 74/513

* cited by examiner

*Primary Examiner*—Richard W L Ridley
*Assistant Examiner*—Matthew Johnson
(74) *Attorney, Agent, or Firm*—Clark Hill PLC

(57) ABSTRACT

The present inventor believes that one of the advantages of the present invention is that when washer 66 abuts the second shoulder 76 and the pin 80 is disengaged from the washer 66the assist mechanism 54 is effectively disengaged from pedal arm 32 and does not impact its operation over the balance of its stroke. Thus assist mechanism 54 only has an effect at the initial portion of the stroke of pedal arm 32, as desired.

3 Claims, 4 Drawing Sheets

CONTROL PEDAL AND ASSIST MECHANISM

FIELD OF THE INVENTION

The present invention relates to control pedals and assist mechanisms therefor. More specifically, the present invention relates to a vehicle control pedal and biasing mechanism to assist the vehicle operator when engaging the vehicle control pedal, such as a clutch pedal.

BACKGROUND OF THE INVENTION

Many vehicle control pedals can have or require non-linear responses. For example, vehicle clutch pedals typically require more force to initially disengage the clutch than they do further in their travel and vehicle engineers typically specify a desired force versus stroke curve that they wish the pedal to meet.

To reduce the force required to operate the clutch, or other control, during the beginning of the pedal stroke various assist mechanisms have been employed in the past. To date, one of the more common assist mechanisms has been a torsion spring connected between the pedal arm and the pedal mounting bracket. When the pedal is pressed to engage a control, such as a clutch, this spring biases the pedal towards the engaged position, reducing the amount of pedal force required to move the pedal through its initial stroke. As the pedal returns to its initial position, when the pedal is released, the spring is tensioned again, storing energy for the start of the next stroke. Other similar spring-based assist mechanisms are also known.

While the known spring assist mechanisms do work, they do suffer from problems. In particular, designing such a spring assist to meet a specified force versus stroke curve can be difficult or impossible. This difficulty is exacerbated by the fact that the assist mechanisms often act, at least to some extent, over the complete intended stroke of the pedal and thus desired assistance at one point of the stroke can have an undesired effect at other points in the stroke.

SUMMARY OF THE INVENTION

It is an object of the present invention to provide a novel control pedal and assist mechanism which obviates or mitigates a disadvantage of the prior art.

According to a first aspect of the present invention, there is provided a control pedal comprising: a frame for mounting to a vehicle; a pedal arm pivotally attached to the frame and the pedal arm having a control arm attached thereto; and an assist mechanism including: a body having a first end pivotally connected to one of the frame and pedal arm and having a second end with a slot to slidably receive a pin mounted to the other of the frame and pedal arm; and a biasing means acting between a portion of the body and a moveable stop on the body, wherein the body is mounted between the pedal arm and the pin such that when the pedal arm is in an at rest position, the pin acts against the moveable stop to compress the biasing means and as the pedal is moved from the at rest position, the biasing means exerts force between the pedal arm and the pin to assist the movement of the pedal arm along its stroke until the moveable stop reaches an end stop, after which further movement of the pedal arm is unassisted.

Preferably, the biasing means is at least one helical spring. The helical spring can be variably wound to alter the assistance force provided by the assist mechanism at different portions of the pedal stroke. Also, the biasing means can comprise two helical springs with different spring force constants and these springs can be arranged coaxially or in series.

According to another aspect of the present invention, there is provided an assist mechanism for a control pedal, comprising: a body having a first end pivotally connected to one of a fixed point on a vehicle and a pedal arm and having a second end with a slot to slidably receive a pin mounted to the other of the fixed point on the vehicle and the pedal arm; and a biasing means acting between a portion of the body and a moveable stop on the body, wherein the body is mounted between the pedal arm and the pin such that when the pedal arm is in an at rest position, the pin acts against the moveable stop to compress the biasing means and as the pedal is moved from the at rest position, the biasing means exerts force between the pedal arm and the pin to assist the movement of the pedal arm along its stroke until the moveable stop reaches an end stop, after which further movement of the pedal arm is unassisted.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
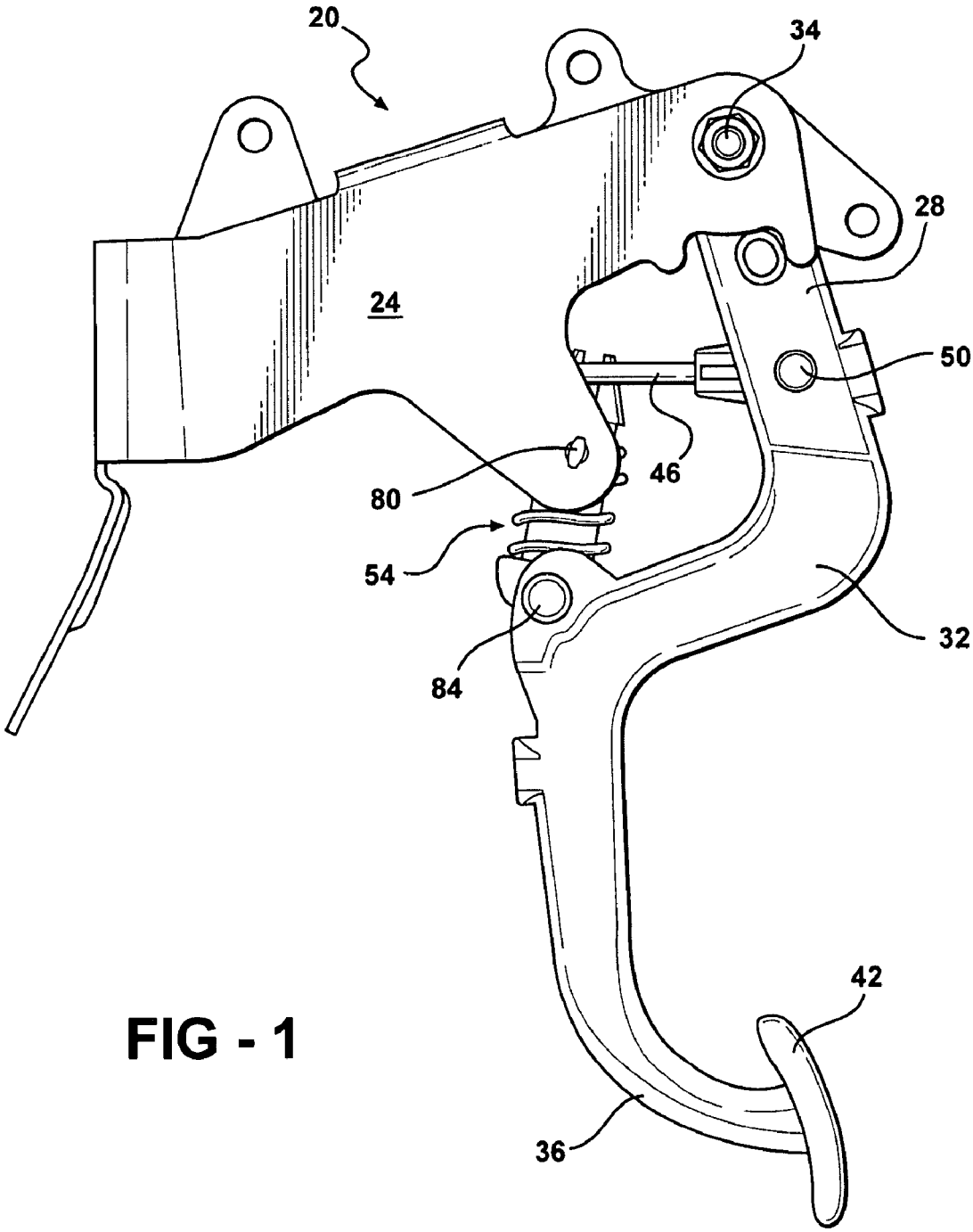
FIG. 1 shows a side view of a control pedal assembly with assist mechanism in accordance with the present invention with the pedal at the rest position.

A control pedal assembly with an assist mechanism in accordance with the present invention is indicated generally at 20 in FIG. 1. Pedal assembly 20 includes a frame 24 which can be attached to a vehicle, not shown, and to which one end 28 of a pedal arm 32 is attached by a pivot pin 34. The other end 36 of pedal arm 28 has a footpiece 42 mounted to it.

Figure 2:
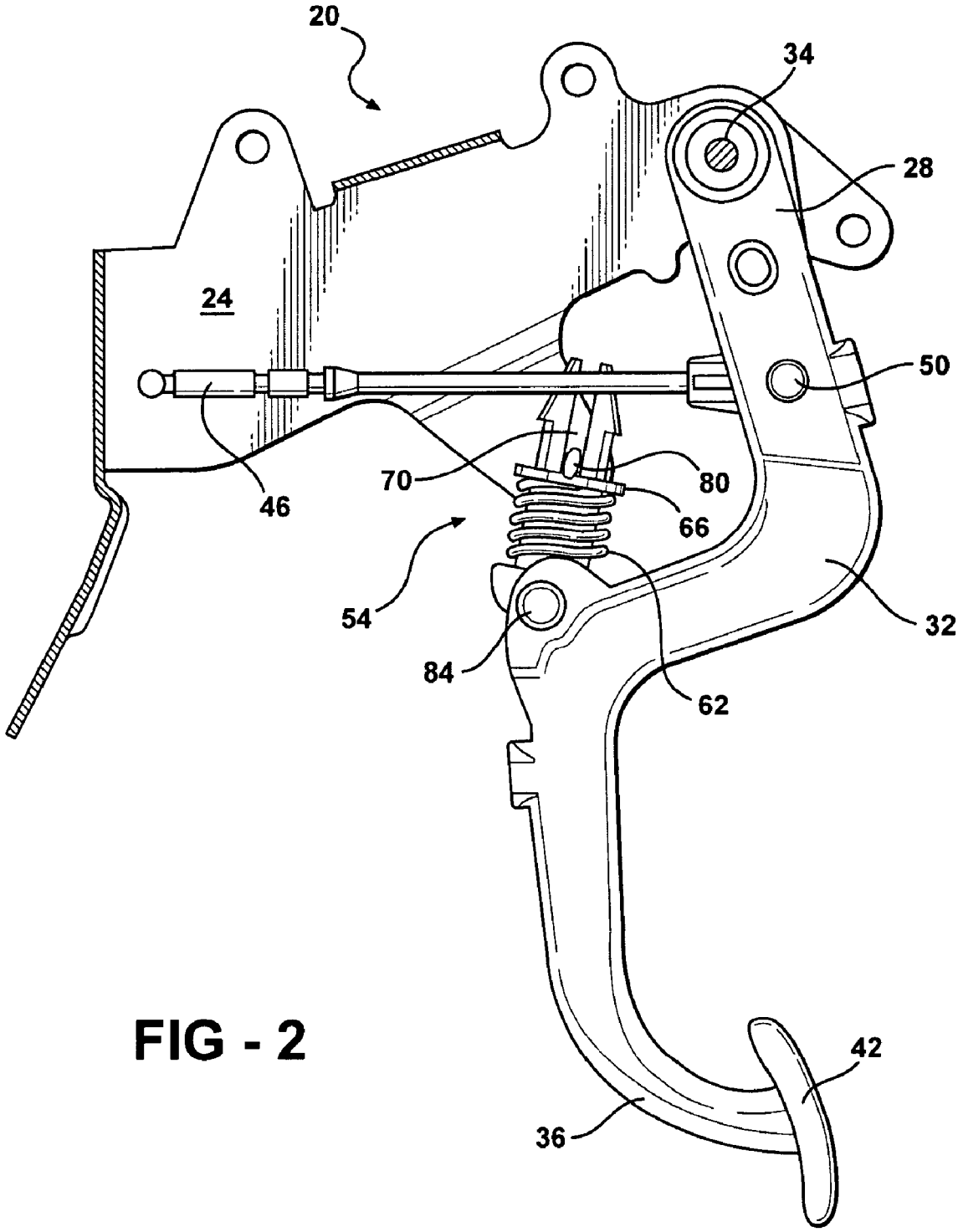
FIG. 2 shows a cut-away side view of the control pedal of FIG. 1.

FIG. 2 shows a similar view of pedal assembly 20 to that of FIG. 1, except that a portion of frame 24 has been removed in the Figure for clarity. As better seen in this Figure, an actuator linkage rod 46 is connected to pedal arm 32 adjacent first end 28 by a pivot pin 50. The end of linkage rod 46 distal pivot pin 50 is connected to the control device, not shown, operated by pedal assembly 20. The actual control device operated is not particularly limited and can include hydraulic master cylinders for clutch mechanisms and/or brakes or other devices.

Figure 3A:
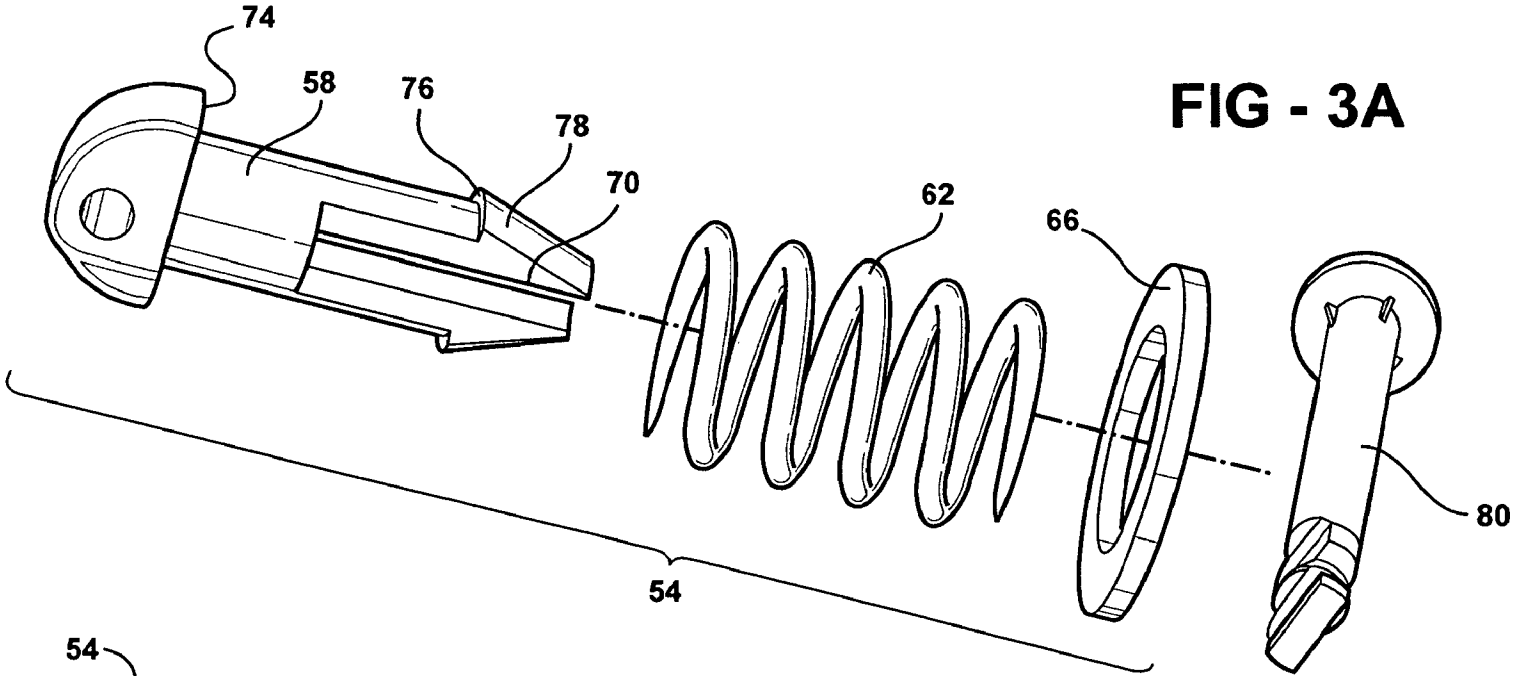
FIG. 3*a* shows an exploded view of an assist mechanism in accordance with the present invention.
Figure 3B:
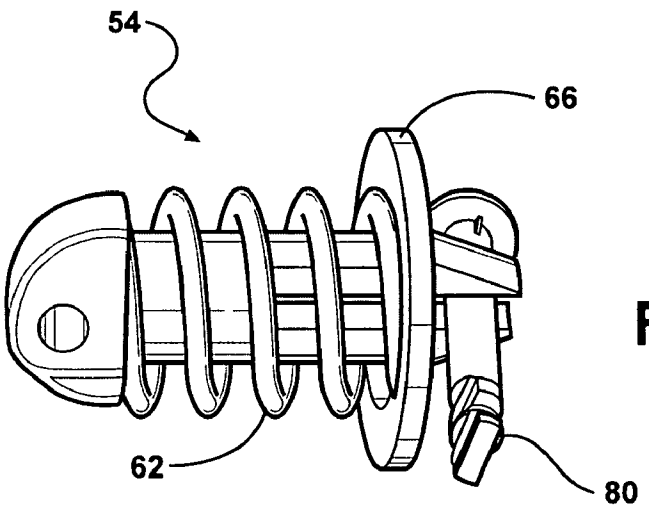
FIG. 3*b* shows an assembled view of the assist mechanism of FIG. 3*a*.

As best seen in FIGS. 3*a* and 3*b*, the present invention includes an assist mechanism 54 which comprises a biasing means carrier 58, at least one biasing means, such as helical spring 62 and a moveable stop, such as retaining washer 66. Carrier 58 includes a longitudinal slot 70 along a portion of its length and carrier 58 has a first shoulder 74 against which one end of spring 62 abuts and a second shoulder 76 against which washer 66 will abut. The end of spring 62 distal shoulder 74 abuts washer 66 when mechanism 54 is assembled as shown in FIG. 3*b*. The wedge shaped end of carrier 58 adjacent shoulder 76 allows spring 62 and washer 66 to be placed on carrier 58, with washer 62 temporarily compressing the sides of carrier 58 during assembly as washer 66 rides up the wedge surfaces until snaps over the end of the wedge surfaces and engages shoulder 76. Washer 66, and spring 62, are then captive on carrier 58

A stop pin 80, which is mounted to frame 24, is disposed in slot 70 and prevents compression of the wedge shaped end 78 of carrier 58 to prevent removal of washer 66. Pin 80 can act against retaining washer 66 to compress spring 62 as described in more detail below. As shown in FIG. 2, at the end of carrier 58 adjacent the shoulder 74, carrier 58 is mounted to pedal arm 32 by a pivot pin 84.

With pedal arm 32 in the rest position illustrated in FIGS. 1 and 2, stop pin 80 is engaged with the washer 66 to compress spring 62. As can be seen, in this rest position, carrier 58 is positioned over-center with respect to the pivot point 34 of pedal arm 32 so that, as pedal arm 32 is depressed by a vehicle operator, compressed spring 62 will act between pin 84 on pedal arm 32 and stop pin 80 on frame 24, thus reducing the force the vehicle operator must employ to depress pedal arm 32.

Figure 4:
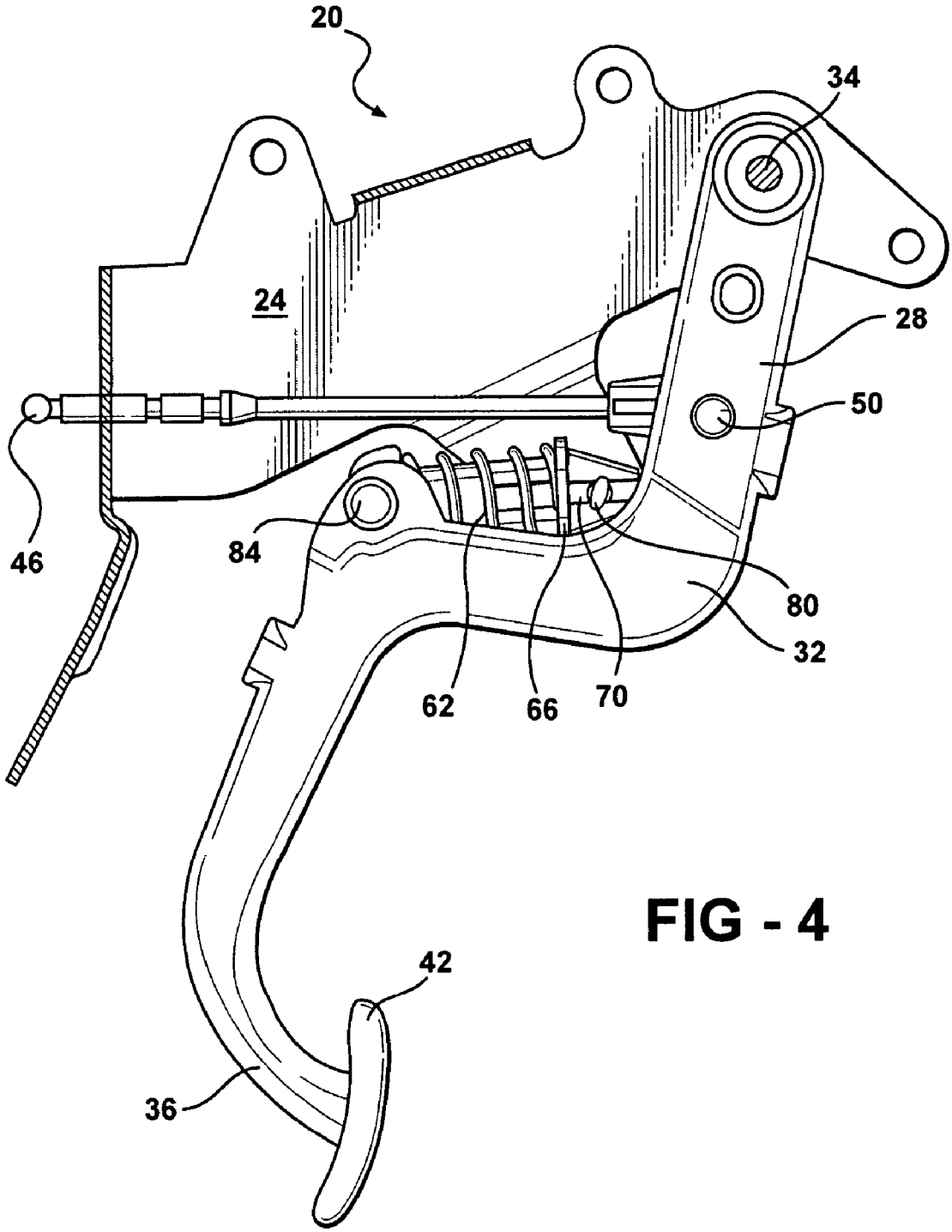
FIG. 4 shows the cut-away side view of FIG. 2 with the pedal depressed.

As pedal arm 32 is further depressed, the carrier 58 moves relative to the stop pin 80 such that shoulder 74 moves away from the pin 80, allowing spring 62 to decompress until washer 66 abuts shoulder as shown in FIG. 4. Once spring 62 has extended such that washer 66 abuts shoulder 76, spring 62 provides no further force to pedal arm 36 and the pin 80 is disengaged from the washer 66.

As the vehicle operator releases pedal arm 32, the carrier 58 moves relative to the pin 80 such that the first shoulder 74 moves toward the pin 80. The pin 80 will again abut washer 66 and compress spring 62 until pedal arm 32 returns to the at rest position.

The present inventor believes that one of the advantages of the present invention is that when washer 66 abuts the second shoulder 76 and the pin 80 is disengaged from the washer 66 the assist mechanism 54 is effectively disengaged from pedal arm 32 and does not impact its operation over the balance of its stroke. Thus assist mechanism 54 only has an effect at the initial portion of the stroke of pedal arm 32, as desired.

A stop pin 80, which is mounted to frame 24, is disposed in slot 70 and prevents compression of the wedge shaped end 78 of carrier 58 to prevent removal of washer 66. Pin 80 can act against retaining washer 66 to compress spring 62 as described in more detail below. As shown in FIG. 2, at the end of carrier 58 adjacent the first shoulder 74, carrier 58 is mounted to pedal arm 32 by a pivot pin 84.

With pedal arm 32 in the rest position illustrated in FIGS. 1 and 2, stop pin 80 is engaged with the washer 66 to compress spring 62. As can be seen, in this rest position, carrier 58 is positioned over-center with respect to the pivot point 34 of pedal arm 32 so that, as pedal arm 32 is depressed by a vehicle operator, compressed spring 62 will act between pin 84 on pedal arm 32 and stop pin 80 on frame 24, thus reducing the force the vehicle operator must employ to depress pedal arm 32.

As pedal arm 32 is further depressed, the carrier 58 moves relative to the stop pin 80 from such that the first shoulder 74 moves away from the pin 80, allowing spring 62 to decompress until washer 66 abuts the second shoulder 76, as shown in FIG. 4. Once spring 62 has extended such that washer 66 abuts the second shoulder 76, spring 62 provides no further force to pedal arm 32 and the pin 80 is disengaged from the washer 66.

As the vehicle operator releases pedal arm 32, the carrier 58 moves relative to the pin 80 such that the first shoulder 74 moves toward the pin 80. The pin 80 will again abut washer 66 and compress spring 62 until pedal arm 32 returns to the at rest position.

We claim:

1. An assist mechanism for a control pedal for an automotive vehicle, the assist mechanism comprising:

a body having a first end pivotally connected to a pedal arm and having a second end with an open-ended slot to slidably receive a pin mounted to the vehicle, the first end defining a first shoulder and the second end defining a second shoulder;

a moveable stop slidably mounted to the body; and a biasing means acting between the first shoulder and the moveable stop on the body, wherein the body is mounted between the pedal arm and the pin such that when the pedal arm is in an at rest position, the pin acts against the moveable stop to compress the biasing means thereby urging the moveable stop away from the second shoulder and as the pedal arm is moved from the at rest position, the biasing means exerts force between the pedal arm and the pin to assist the movement of the pedal arm along its stroke until the moveable stop abuts the second shoulder, after which further movement of the pedal arm is unassisted.

2. A control pedal for an automotive vehicle, the control pedal comprising:

a frame for mounting to the vehicle;

a pedal arm pivotally attached to the frame and the pedal arm having a control arm attached thereto; and an assist mechanism including:

a body having a first end pivotally connected to the pedal arm and having a second end with an open-ended slot to slidably receive a pin mounted to the frame, the first end defining a first shoulder and the second end defining a second shoulder;

a moveable stop slidably mounted to the body; and a biasing means including at least one helical spring acting between the first shoulder and the moveable stop on the body, wherein the body is mounted between the pedal arm and the pin such that when the pedal arm is in an at rest position, the pin acts against the moveable stop to compress the biasing means thereby urging the moveable stop away from the second shoulder and as the pedal arm is moved from the at rest position, the biasing means exerts force between the pedal arm and the pin to assist the movement of the pedal arm along its stroke until the moveable stop abuts the second shoulder, after which further movement of the pedal arm is unassisted.

3. A control pedal according to claim 2 wherein the second end of the body is a wedge shaped end defining the second shoulder.

* * * * *